219-121
2/1/83

SR

XR 4,371,312

United States Patent [19]

Tank

[11] 4,371,312

[45] Feb. 1, 1983

[54] BUCKET FOR AN ADJUSTABLE TURBINE INLET GUIDE BAFFLE SYSTEM

[75] Inventor: Eggert Tank, Wernau, Fed. Rep. of Germany

[73] Assignee: Daimler-Benz Aktiengesellschaft, Stuttgart, Fed. Rep. of Germany

[21] Appl. No.: 248,829

[22] Filed: Mar. 30, 1981

[30] Foreign Application Priority Data

Apr. 3, 1980 [DE] Fed. Rep. of Germany ..... 3013076

[51] Int. Cl.[3] ..... F01D 1/02; B05D 1/00

[52] U.S. Cl. ..... 415/200; 415/212 A; 415/216; 416/241 R; 156/325; 219/121 PL; 29/156.8 R; 29/156.8 B; 427/34

[58] Field of Search ..... 427/34; 156/325; 252/49.7; 29/156.8 B, 156.8 R, 156.8 H, 421 R; 416/241 R; 415/12, 212 R, 200, 212 A, 213 R, 148, 216; 75/123 K, 170, 171, 251, 255; 219/121 PL

[56] References Cited

U.S. PATENT DOCUMENTS 3,486,833 12/1969 Miller et al. ..... 415/212 A X
3,801,353 4/1974 Brill-Edwards ..... 415/212 A
4,003,939 12/1977 Weaver et al. ..... 29/156.8 R
4,173,685 11/1979 Weatherly ..... 427/34 X
4,275,090 6/1981 McComas et al. ..... 427/34

FOREIGN PATENT DOCUMENTS 2816520 10/1979 Fed. Rep. of Germany ..... 427/34

*Primary Examiner*—Thurman K. Page
*Attorney, Agent, or Firm*—Paul M. Craig, Jr.

[57] ABSTRACT

A bucket for an adjustable turbine guide baffle system for gas turbines is formed of an alloy material comprised of a dispersion-strengthened Fe-Cr-Al alloy containing 64.5–75.5% by weight of Fe, 15–25% by weight of Cr, 3–8% by weight of Al, 0.1–1% by weight of Ti, 0–3% by weight of Co, 0.1% by weight of Y or Ce, and 0.1–1.5% by weight of yttrium oxide or aluminum oxide. The bucket has a shank which is under friction stress in the guide baffle system and which is coated with a layer of slip-providing material that contains 90–100% by weight of nickel oxide and 0–10% by weight of one or more oxides of chromium, aluminum, zirconium, titanium, iron, manganese, or magnesium.

13 Claims, 3 Drawing Figures

BUCKET FOR AN ADJUSTABLE TURBINE INLET GUIDE BAFFLE SYSTEM

This invention relates to a bucket or baffle for an adjustable turbine inlet guide baffle system.

As is known, the degree of efficiency of gas turbines increases with rising gas temperatures. However, temperature elevation is limited by the heat resistance of the components. With the bucket materials heretofore employed for this purpose, it is hardly possible to operate at gas temperatures higher than about 850° C., corresponding to a bucket temperature of about 800° C.; in this connection reference is made to buckets of adjustable turbine inlet guide baffles or vanes known to those skilled in the art and described, for example, in the publication ASME No. 77-GT-105 (The American Society of Mechanical Engineers), Mar. 1977.

Therefore, it is an object of this invention to provide a bucket for an adjustable turbine inlet guide baffle system suitable for use at substantially higher operating temperatures.

This object has been attained by the bucket provided by the present invention wherein the shank portion of the bucket is coated with a slip or anti-friction layer.

The bucket of this invention is formed of an alloy material comprised of a conventional, dispersion-strengthened Fe-Cr-Al alloy containing about 64.5–75.5% by weight of Fe, 15–25% by weight of Cr, 3–8% by weight of Al, 0.1–1% by weight of Ti, 0–3% by weight of Co, 0–1% by weight of Y or Ce, as well as 0.1–1.5% by weight of yttrium oxide or aluminum oxide. An alloy consisting of about 75.5% by weight of Fe, 19% by weight of Cr, 4.5% by weight of Al, 0.5% by weight of Ti, and 0.5% by weight of yttrium oxide is preferred for forming the bucket of this invention. These materials, known per se from the class of dispersion-strengthened high-temperature materials are obtainable commercially, for example, under the name of Incoloy MA 956. The cylindrical shank of the bucket, serving for rotation of the bucket and thus subject to friction, is coated with a slip-providing (i.e. anti-friction) layer of nickel oxide (NiO) or a mixture of nickel oxide with up to 10% by weight of one or more oxides of chromium, aluminum, zirconium, titanium, iron, manganese, or magnesium (e.g. $Cr_2O_3$, $Al_2O_3$, $ZrO_2$, $TiO_2$, $Fe_2O_3$, $Fe_3O_4$, MuO, MgO). After the spraying step these oxides form a solid solution with the nickel oxide, whereby the oxidation number of the oxides of Fe and Mu can no longer be determined exactly. A slip-providing layer consisting of 90–95% by weight of nickel oxide and 5–10% by weight of magnesium oxide is especially preferred.

The slip-providing layer is applied by customary plasma spraying, wherein the components, as is known, must be present in the form of flowable powders, i.e., powders which can be sprayed by means of a plasma spraying device. The spraying step can be conducted with a mixture produced by the mechanical intermixing of nickel oxide powder and a powder of the second component, as well as with a powder prepared from a solid solution of nickel oxide and the additional oxide. Such a powder is obtainable, for example, by sintering of nickel oxide with the second component and comminution of the sintered mixture to a particle size suitable for plasma spraying (about 20–200 μm).

The slip-providing layer (i.e. the antifriction layer) is sprayed onto the bucket shank in a thickness of 0.1–0.5 mm, preferably 0.2–0.3 mm. Application can take place directly onto the shank surface roughened by means of the usual methods, e.g. by corundum blasting or sandblasting; a slight improvement in adhesion of the layer is obtained by the preliminary spraying of a thin layer (about 0.05 mm) of one of the conventional, adhesion-promoting nickel-aluminide materials, containing generally about 95% by weight of nickel and 5% by weight of aluminum, wherein optionally a corresponding quantity of nickel is replaced by additives such as chromium, molybdenum, or iron in minor amounts (about 5% by weight), available, for example, under the designations of Metco 404, 405, 443, 444, 447, or 450 on the market.

After application, the slip layer, (which—as all sprayed layers—is porous), is post-sintered by 5–24 hours of annealing at 950°–1250° C. and subsequently ground to the proper dimension. This layer has a hardness of about 5000 $N/mm^2$ at room temperature.

Thus, this layer, at room temperature and at 1000° C., is softer than the bushings of $Al_2O_3$ wherein the coated bucket shank is customarily supported. Besides $Al_2O_3$, it is, of course, also possible to utilize other, correspondingly hard and high-temperature-resistant bearing materials for the bucket shank, e.g. zirconium oxide ($ZrO_2$), chromium oxide ($Cr_2O_3$), as well as mixtures of these oxides.

The slip layer and the alloy material of the bucket each has thermal expansion coefficients $\alpha$, between 20° C. and 1000° C., of, respectively, $15 \cdot 10^{-6}/°C.$, so that thermally produced shearing stresses do not occur between the bucket shank and the slip layer. As a result, the slip layer does not become detached from the bucket shank during operation, even at great temperature fluctuations. With loads of 0.5–1 m $sec^{-1}$, friction coefficients such as $\mu=0.27$ are measured for the slip layer with very minor abrasion. The buckets of this invention are stable up to temperatures of about 1000° C., corresponding to a gas temperature in the guide baffle system of about 1150° C.

The advantages of the bucket according to the invention thus reside, above all, in a heretofore unattained high temperature resistance, combined with excellent adhesion of the slip layer and a bearing friction which is not excessive.

The bucket or vane of the turbine system of this invention will be further understood from the following detailed description and the accompanying drawing wherein.

Figure 1:
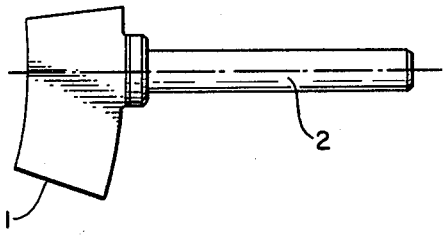
FIG. 1 shows a side elevational view with the bucket blade or vane at one end and the shank at the other end.
Figure 2:
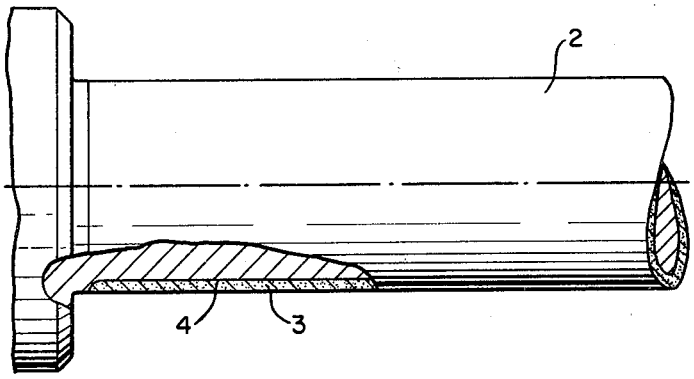
FIG. 2 shows an enlarged partial section of the shank end.

In FIG. 1, the blade 1 is shown integrally formed with a rotatable shank 2. A sprayed on sliding or slip-providing layer 3 is formed on the shank as illustrated in FIG. 2. An adhesion-producing layer 4 may also be provided between the alloy material 5 forming the shaft 2 and the slip-providing layer 3.

Figure 3:
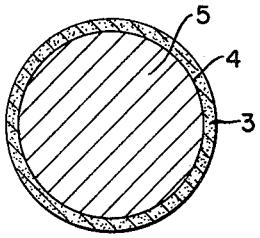
FIG. 3 shows a cross-sectional view taken through the shank end of the bucket.

In FIG. 3 the arrangement of the slip-providing layer 3 on the circumference of the shank 5 is further shown. Here again the adhesion producing layer 4, which may optionally be applied is illustrated.

The following is an example of applying the slip-providing layer to the shank.

The slip-providing layer was applied as follows:

A spray gun (spraying apparatus) METCO Plasma Spray Gun Type 7 MB with a plasma nozzle (spray nozzle) Size G (US-make) was used.

The spraying conditions (spraying parameters) were chosen as follows:

gas sprays (i.e. plasma gases): $N_2$ and $H_2$.

Flow-through: 80($N_2$) and 20 ($H_2$) S.C.F.H. (standard cubic feet per hour) respectively, with a gas pressure of 50 p.s.i. respectively.

Current intensity: 400 amperes

Voltage: about 70 volts

Spraying distance (gun-workpiece) 100 mm (14 inches)

Sprayed powder quantity: 10 lbs/hour

Size of powder grain: 30 to 90 μm in diameter

Thickness of the sprayed-on layer: about 0.3 mm.

What is claimed is:

1. A bucket for an adjustable turbine guide baffle system for gas turbines said bucket having a shank which is coated with a layer of slip-providing material by plasma spraying particles of the slip-providing material onto said shank, said particles of slip-providing material consisting essentially of 90–100% by weight of nickel oxide and 0–10% by weight of one or more oxides of chromium, aluminum, zirconium, titanium, iron, manganese, or magnesium.

2. A bucket according to claim 1, characterized in that the bucket is made of an alloy composition consisting essentially of 75.5% by weight of Fe, 19% by weight of Cr, 4.5% by weight of Al, 0.5% by weight of Ti, and 0.5% by weight of yttrium oxide.

3. A bucket according to claim 1 or 2, characterized in that the shank of the bucket is plasma spray coated with a layer of a slip-providing material consisting essentially of 90–95% by weight of nickel oxide and 5–10% by weight of magnesium oxide.

4. A bucket according to claim 1 or 2, characterized in that the thickness of the layer of the slip-providing material is 0.1–0.5 mm.

5. A bucket according to claim 1, characterized in that the layer of slip-providing material is porous and is best-sintered by 5–24 hours of annealing at 950° C. to 1250° C. to provide a hardness on the order of about 5000N/mm$^2$ at room temperature.

6. A process for producing an antifriction layer on a shank portion of a bucket for use in an adjustable turbine guide baffle system, which comprises coating the shank portion of the bucket with a layer of antifriction material consisting essentially of 90–100% by weight of nickel oxide and 0–10% by weight of one or more oxides of chromium, aluminum, zirconium, titanium, iron, manganese or magnesium by plasma spraying particles of said antifriction material on said shank portion and, thereafter, post-sintering the antifriction material coated on said shaft portion.

7. The process according to claim 6, characterized in that the antifriction material after being coated on the bucket is post-sintered for 5–24 hours at 950°–1250° C.

8. The process according to claim 6, characterized in that the antifriction layer is coated by plasma spraying particles of nickel oxide or a mixture of particles of nickel oxide and particles of the other oxide.

9. The process according to claim 8, characterized in that the particles of the oxides are sintered and comminuted to a particle size of from 20–200 μm prior to being plasma sprayed.

10. A bucket according to claim 1, characterized in that the bucket is formed of an alloy material comprised of a dispertion-strengthened Fe-Cr-Al alloy containing 64.5–75.5% by weight of Fe, 15–25% by weight of Cr, 3–8% by weight of Al, 0.1–1% by weight of Ti, 0–3% by weight of Co, 0.1% by weight of Y or Ce, and 0.1–1.5% by weight of yttrium oxide or aluminum oxide.

11. The process according to claim 6, wherein said bucket is formed of a dispersion-strengthened Fe-Cr-Al alloy.

12. The process according to claim 6, further characterized in that prior to plasma spraying of said particles of the antifriction material, the shank portion is sprayed with a thin layer of adhesion-promoting nickel-aluminide material.

13. The process according to claim 12, characterized in that the nickel-aluminide material contains about 95% by weight of nickel and 5% by weight of aluminum.

* * * * *